US007293615B2

(12) United States Patent
Medd

(10) Patent No.: US 7,293,615 B2
(45) Date of Patent: Nov. 13, 2007

(54) EARTH BORING SYSTEM

(75) Inventor: Morris J. Medd, North Bay (CA)

(73) Assignee: J.S. Redpath Limited, North Ray (CA)

( * ) Notice: Subject to any disclaimer, the term of this patent is extended or adjusted under 35 U.S.C. 154(b) by 290 days.

(21) Appl. No.: 10/994,200

(22) Filed: Nov. 22, 2004

(65) Prior Publication Data

US 2005/0189105 A1 Sep. 1, 2005

Related U.S. Application Data

(60) Provisional application No. 60/523,319, filed on Nov. 20, 2003.

(51) Int. Cl.
*E21D 1/00* (2006.01)

(52) U.S. Cl. ..... 175/95; 175/86; 175/99; 175/94; 299/13

(58) Field of Classification Search ..... 175/86, 175/94, 99, 219, 95; 299/31, 32, 13; 102/319, 102/321, 313, 314
See application file for complete search history.

(56) References Cited

U.S. PATENT DOCUMENTS 3,965,995 A * 6/1976 Sugden ..... 175/57
4,141,414 A 2/1979 Johansson
4,274,675 A 6/1981 Paurat et al.
4,589,502 A 5/1986 Salter et al.
4,646,853 A 3/1987 Sugden et al.
4,732,226 A * 3/1988 Ebeling et al. ..... 175/94

FOREIGN PATENT DOCUMENTS

JP 03-241192 A 10/1991
JP 03-241193 A 10/1991
JP 11-200763 A 7/1999
WO WO 8905391 A1 * 6/1989

* cited by examiner

*Primary Examiner*—David Bagnell
*Assistant Examiner*—Robert Fuller
(74) *Attorney, Agent, or Firm*—Blake, Cassels & Graydon LLP; Brett J. Slaney; John R. S. Orange

(57) ABSTRACT

An earth boring apparatus for sinking shafts and removing shaft material from the shaft, the apparatus having at least two decks; hydraulic means for allowing movement of the decks relative to one another; releasable anchoring means associated with the decks for engaging walls of the shaft to secure the apparatus in a stationary position; whereby the releasable anchoring means of one of the decks engages the wall while the releasable anchoring means of the other deck is released from the wall to allow motion of the other deck along the shaft, in cooperation with the hydraulic means. The apparatus also includes guide means for forcing a bucket for hoisting shaft material from the shaft along a predetermined path, and an in-stage cut-boom drill.

10 Claims, 21 Drawing Sheets

EARTH BORING SYSTEM

This application claims priority from U.S. application Ser. No. 60/523,319 filed on Nov. 20, 2003.

BACKGROUND OF THE INVENTION

1. Field of the Invention

The present invention relates to earth boring systems.

2. Description of the Prior Art

Earth boring systems are used for sinking shafts, and such systems typically use large unitary stages suspended by cables and moved by one or more winches. A stage is generally a multi-decked apparatus with platforms to hold equipment, supplies or workers.

The process of sinking shafts involves the steps of drilling a hole from the stage, placing an explosive charge in the hole and then detonating the charge. The resultant broken rock is removed with a bucket system, and thereafter the process is repeated. The shaft wall is often reinforced with a lining to minimize the chances of the shaft caving in, this step is performed from the stage.

The stage is moved to various positions along the shaft by a winch and cables. This process is labour intensive and dangerous work and the winch, sheaves and cable require careful and continuous monitoring and maintenance.

Other drawbacks are that the stage is subject to bounce from cable stretch, which leads to costly and time consuming process of doubling down cable procedure, difficulty and expense of periodic rope inspection and the depth restriction of cables for stages due to cable safety factors.

SUMMARY OF THE INVENTION

In one of its aspects the present invention provides an earth boring apparatus, the apparatus includes:

at least two decks;

extensible drive members for allowing movement of one of the decks relative to the other;

releasable anchors associated with respective ones of the decks for engaging walls of the shaft to secure the apparatus in a stationary position;

whereby the releasable anchors means of one of the decks engages the wall while the releasable anchors of the other of the decks is released from the wall to allow motion of the other deck along the shaft, under control of said drive members.

In another of its aspects the present invention provides a stage having openings and guides for a bucket used for hoisting shaft material, the bucket is coupled to a bucket crosshead having permanent guide means which force the buckets along a predetermined path through the decks. The bucket crosshead is also equipped with temporary guide means on a frame at right angles to the regular permanent guide means, such that the crosshead can be transferred between the permanent guides and the temporary guides. Advantageously, by using the temporary guides, the crosshead can descend through the stage at increased speeds, such as 360 feet per minute, rather than the creep speed of 120 feet per minute, until the crosshead is finally chaired at a bottom deck of the lower stage.

Advantageously, once the stage has been introduced into shaft, generally by cables and winches, subsequent movement up and down the shaft is achieved using hydraulic means and anchoring means, such that the stage is self-driven.

BRIEF DESCRIPTION OF THE DRAWINGS

These and other features of the preferred embodiments of the invention will become more apparent in the following detailed description in which reference is made to the appended drawings wherein.

DETAILED DESCRIPTION OF THE INVENTION

Figure 1:
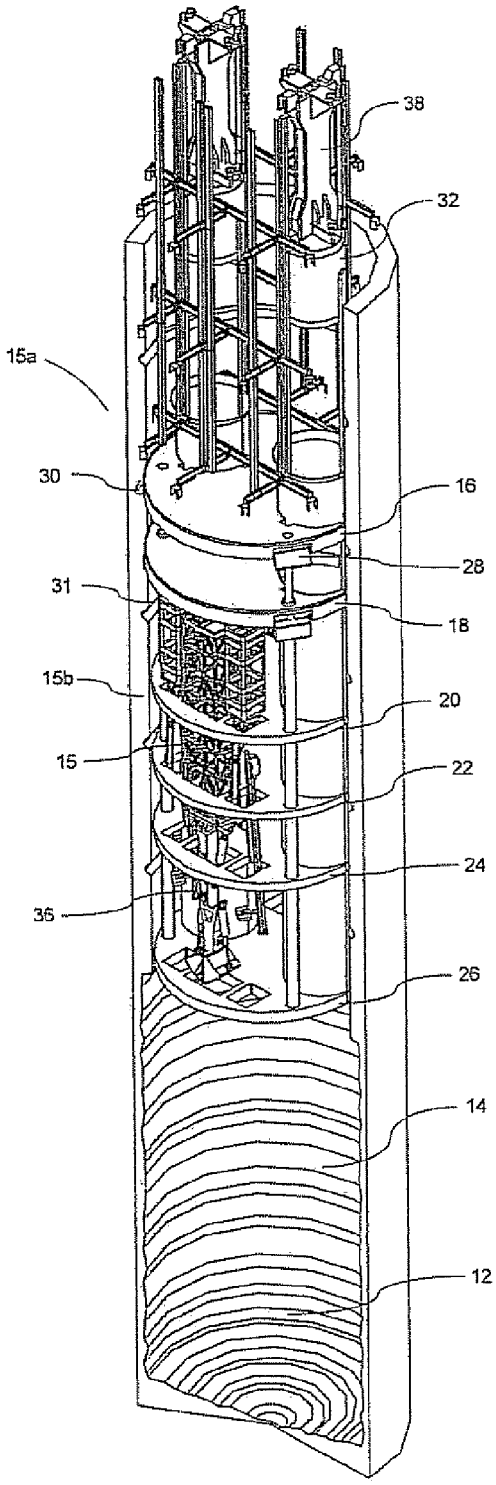
FIG. 1 is a view of an earth boring apparatus in use within a shaft.
Figure 2:
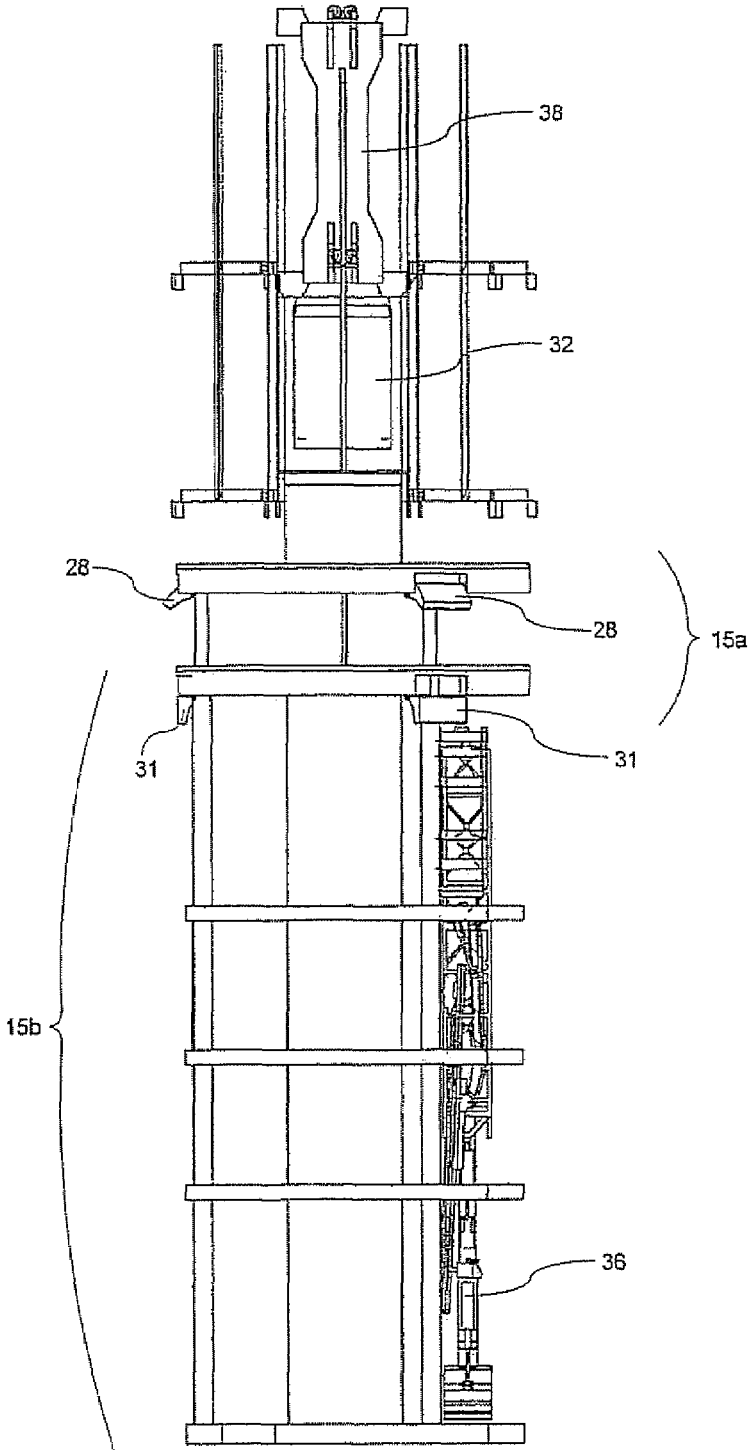
FIG. 2 is a side view of the earth boring apparatus.
Figure 3:
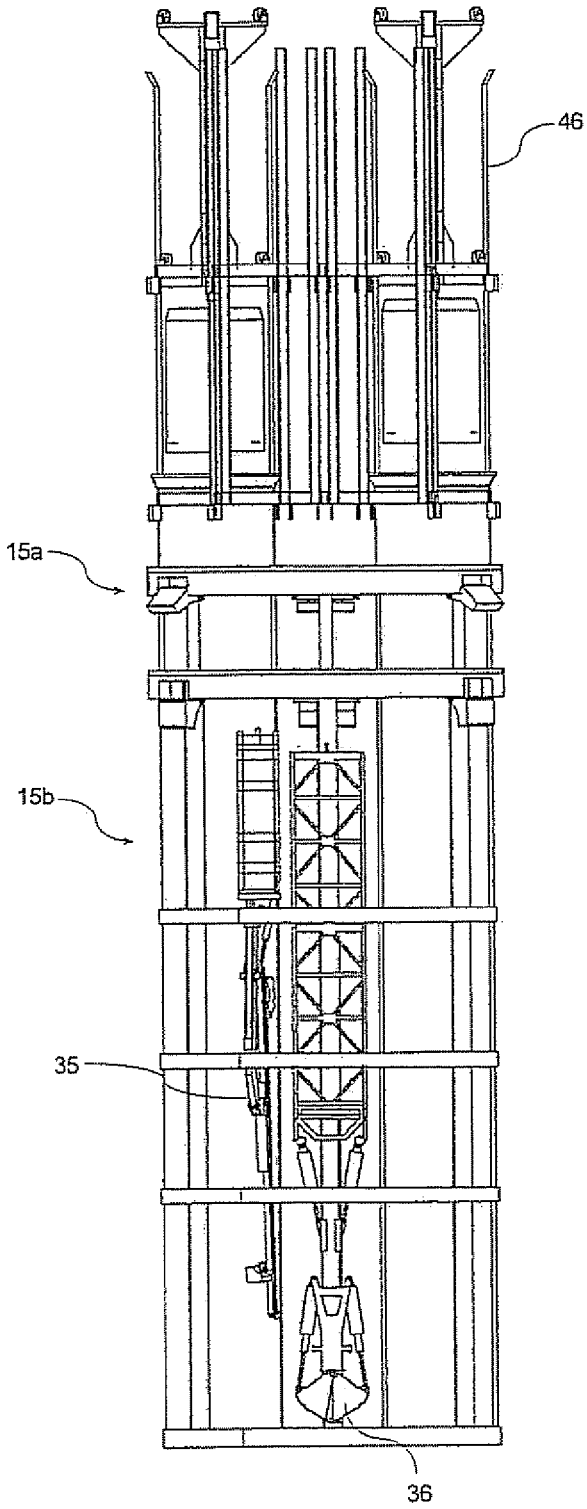
FIG. 3 is a font view of the earth boring apparatus.

Referring to FIGS. 1 to 10, there is shown an earth boring apparatus 10, in a preferred embodiment. The earth boring apparatus 10 is used for excavating from the surface of an opening in the earth. Generally, the earth boring apparatus 10 operates within a shaft 12 which has reinforced walls 14 to minimize the possibility of the shaft 12 from caving in. The walls 14 are reinforced with friction rock stabilizers which include bolts that tighten and exert pressure against the rock wall 14 should lateral rock displacement occur and are lined with concrete to enhance stability. The earth boring apparatus 10 includes a stage 15 having a plurality of decks, such as 16, 18, 20, 22, 24 and 26. The stage 15 includes an upper portion 15*a* with an equipping deck 16, and a lower portion 15*b* having a top deck 18 and other decks 20, 22, 24 and 26. The decks 16-26 are constructed from structural steel components, or other materials exhibiting suitable strength and durability and support service equipment such as power supplies, as well as excavating equipment. After the location of the proposed shaft 12 has been chosen and the shaft collar has been developed, the stage 15 is then lowered into the shaft 12 with sheaves, winches and cables which allow the stage 15 to be suspended from the surface prior to chairing within the shaft 12. The stage 15 is chaired within the shaft 12 by retractable chairing means 28 or anchoring means which engage recessed pockets 30 spaced along the depth of the shaft 12 at predetermined distances as describe more fully with reference to FIG. 18 below.

Figure 18:
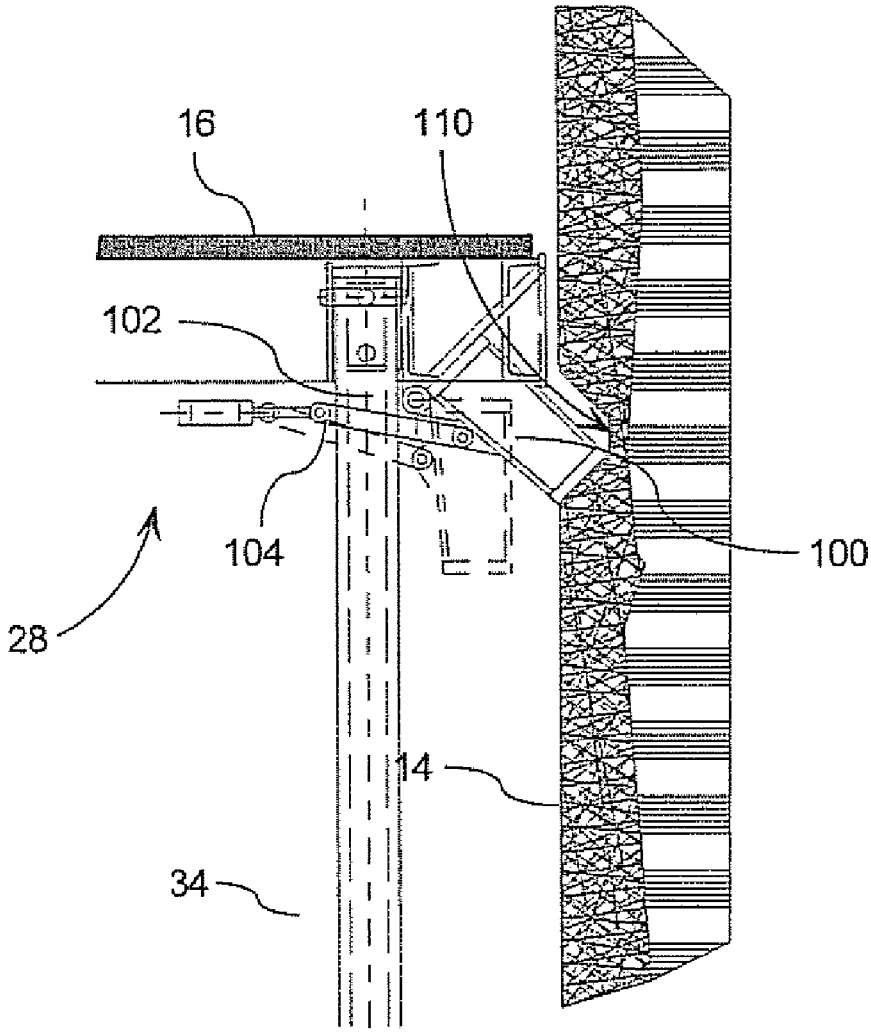
FIG. 18 is an enlarged view of a component used in the apparatus of FIG. 16.

The upper stage portion 15 has a structural ring 17 that supports the equipping deck 16. The equipping deck 16 provides a platform to hold supplies such as concrete, steel for lining the shaft 12, or shaft sinking personnel. The lower stage portion 15*b* is formed as a cylindrical framework with the decks 18-26 spaced apart from each other by fixed distances. A set of hydraulic cylinders, typically 3, are circumferentially spaced and extend between the upper stage portion 15*a* and lower stage portion 15*b*. The cylinders are telescopic and control movement between the equipping deck 16 and the top deck 18. Anchoring means 28 are provided at spaced intervals on the equipping deck 16 and the top deck 18 as shown in FIG. 18. Each of the anchoring means 28 includes a leg 100 pivotally secured by a pin 102 to the respective deck 16, 18. A link 104 from the leg 100 to a leg operating cylinder 106 that can extend and retract to cause pivotal movement of the leg 100. In its extended position, the leg 100 radially beyond the deck 16, 18 to engage a pocket 110 formed in the wall 14 of the shaft 12.

At any given moment the stage 15 is anchored by chairing legs 100 equipping deck or the top deck. The stroke of the cylinders 34 permit the lower stage 15*b* to be moveable from zero to sixty feet from the equipping deck 16 using hydraulic lifting devices 34. By sequenced operation, the stage 15 "walks" up and down the shaft 12 to permit progressive excavation.

In a rest position with both sets of chairing means 28 and the top extended and engaging the respective chairing pocket in the shaft wall 14 so as to securely locate the stage 15. To lower the lower portion 15*b*, the top deck chairing legs 100 are then released to a retracted position away from the chairing pocket 30 and clear of the shaft wall 14. Using the telescoping hydraulic cylinders 34, the lower stage 15*b* is caused to move relative to the stationary equipping deck 16. Similarly, the equipping deck 16 can be moved relative to the lower stage 15*b* by maintaining the lower stage 15*b* in a stationary position via the engagement of the top deck chairing legs 100 with the chairing pocket 30, while the equipping deck chairing legs 100 are released. Advantageously, the stage 15 can "walk" up and down using the chairing legs 100 and the telescoping hydraulic cylinder 34.

The lack of cables also provides for less clutter and less congestion on the decks 16-26 and thus provides greater flexibility of movement for the shaft personnel. Another advantage of the separable decks 16-26 is that there is no requirement to move the whole stage 15 away from the blast site, as only the lower stage 15*b* needs to have sufficient clearance of the blast site, while the remaining equipping deck 16 is stationary. Therefore, it is more efficient to move a portion of stage 15, relative to the equipping deck 16 as the drilling/blasting and mucking continues.

Figure 4A:
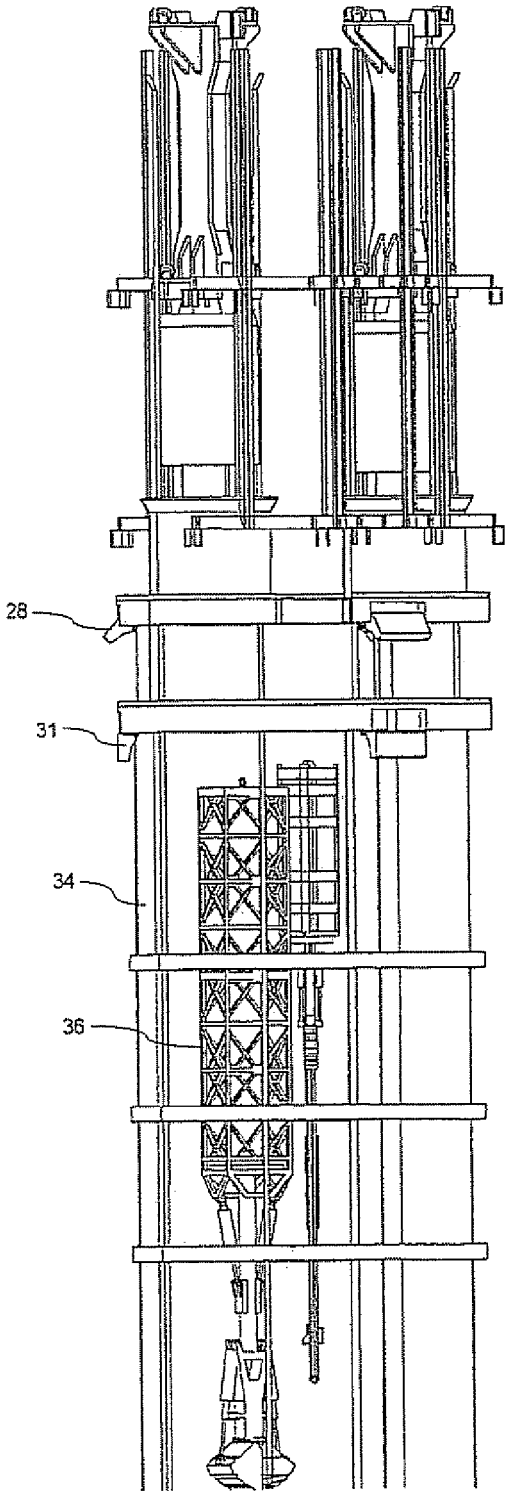
FIG. 4*a* is an exploded view of an equipping deck.
Figure 4B:
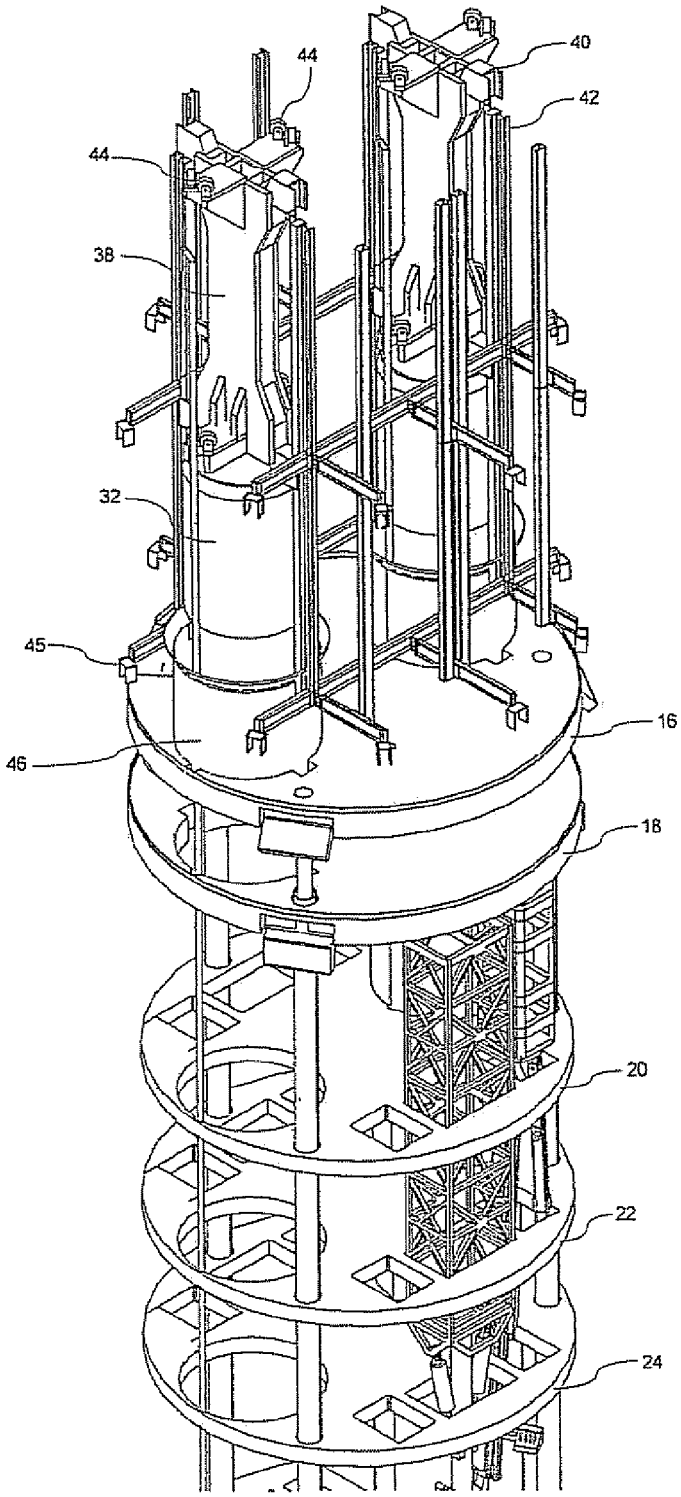
FIG. 4*b* is an exploded isometric view of the equipping deck.
Figure 4C:
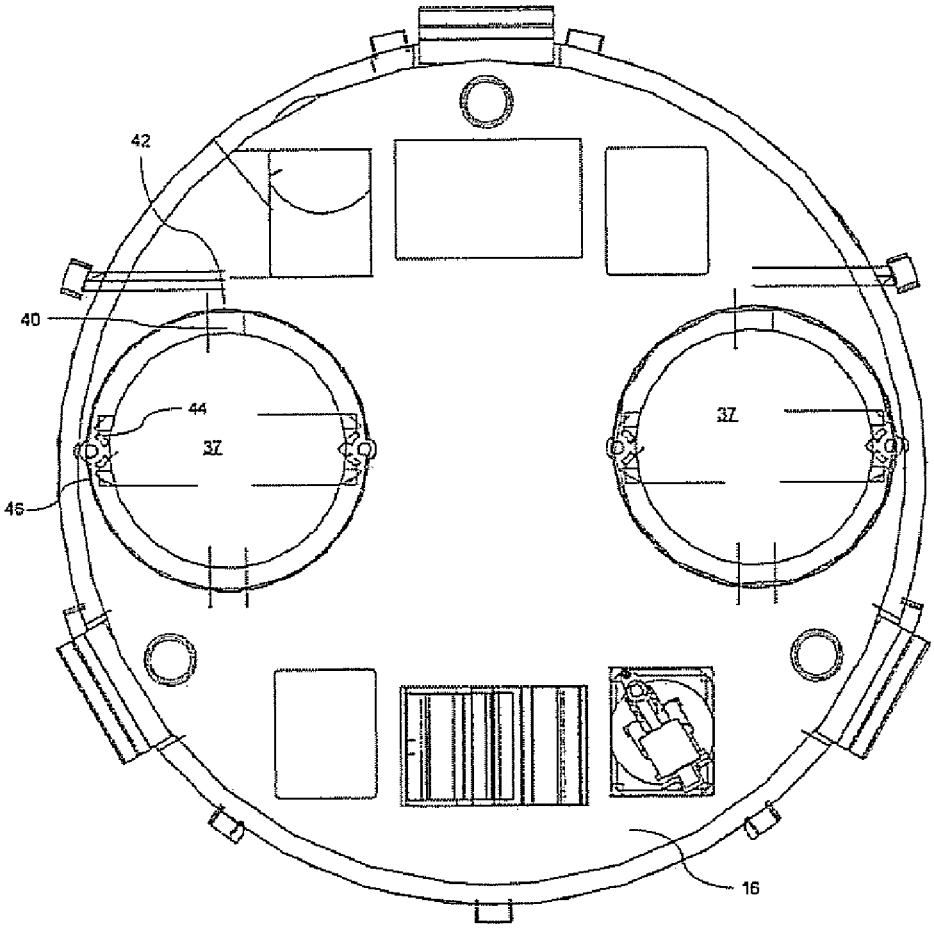
FIG. 4*c* is a top view of the equipping deck.
Figure 4D:
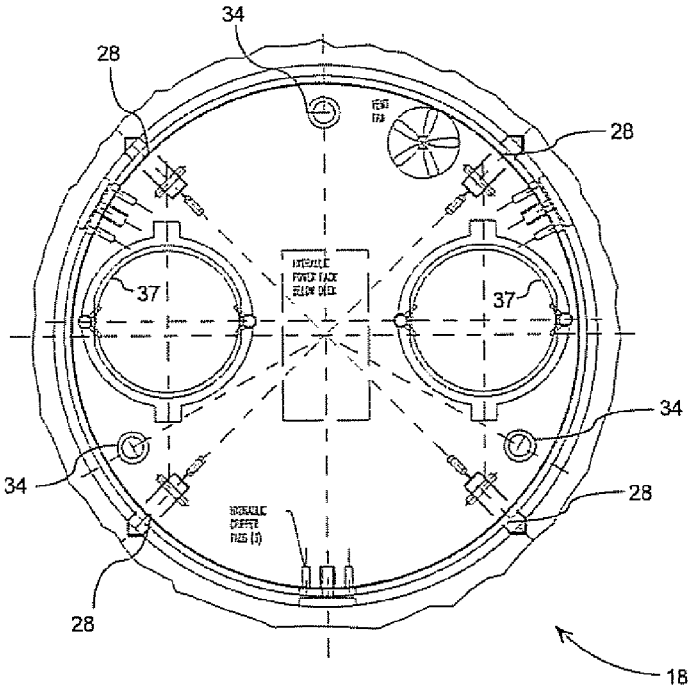
FIG. 4*d* is a plan view of a top deck.
Figure 4E:
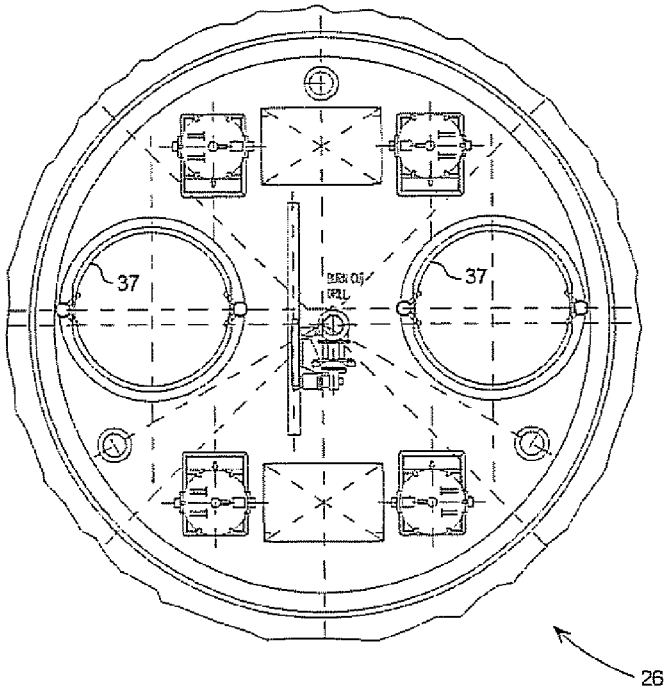
FIG. 4*e* is a plan view of a stage deck.
Figure 5:
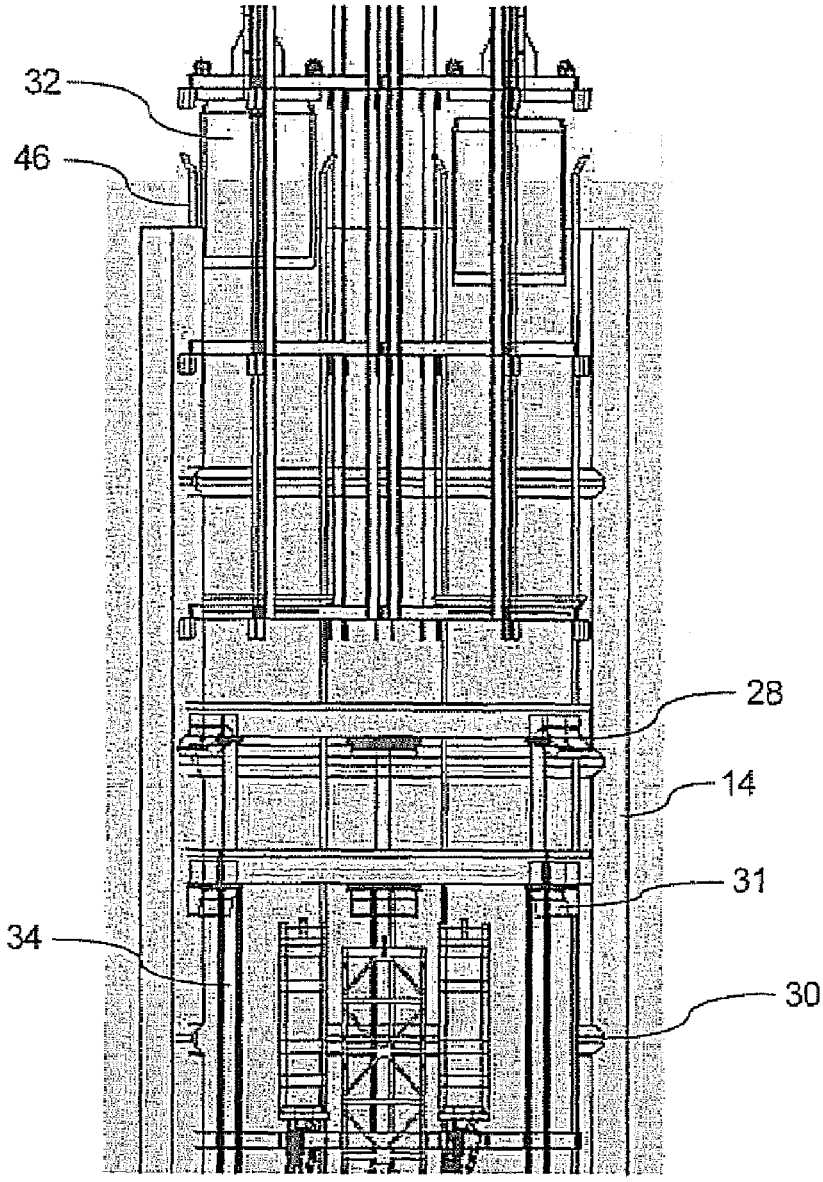
FIG. 5 is an exploded view of a stage in the shaft.
Figure 6:
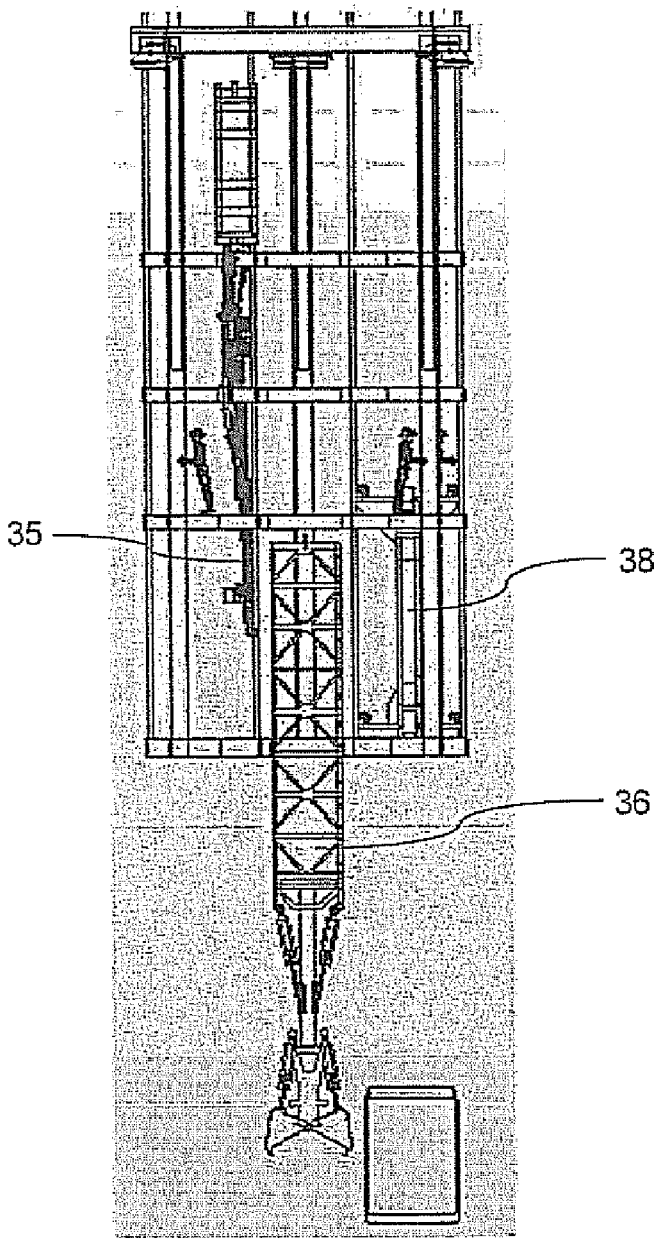
FIG. 6 is a view of the bottom deck.
Figure 7:
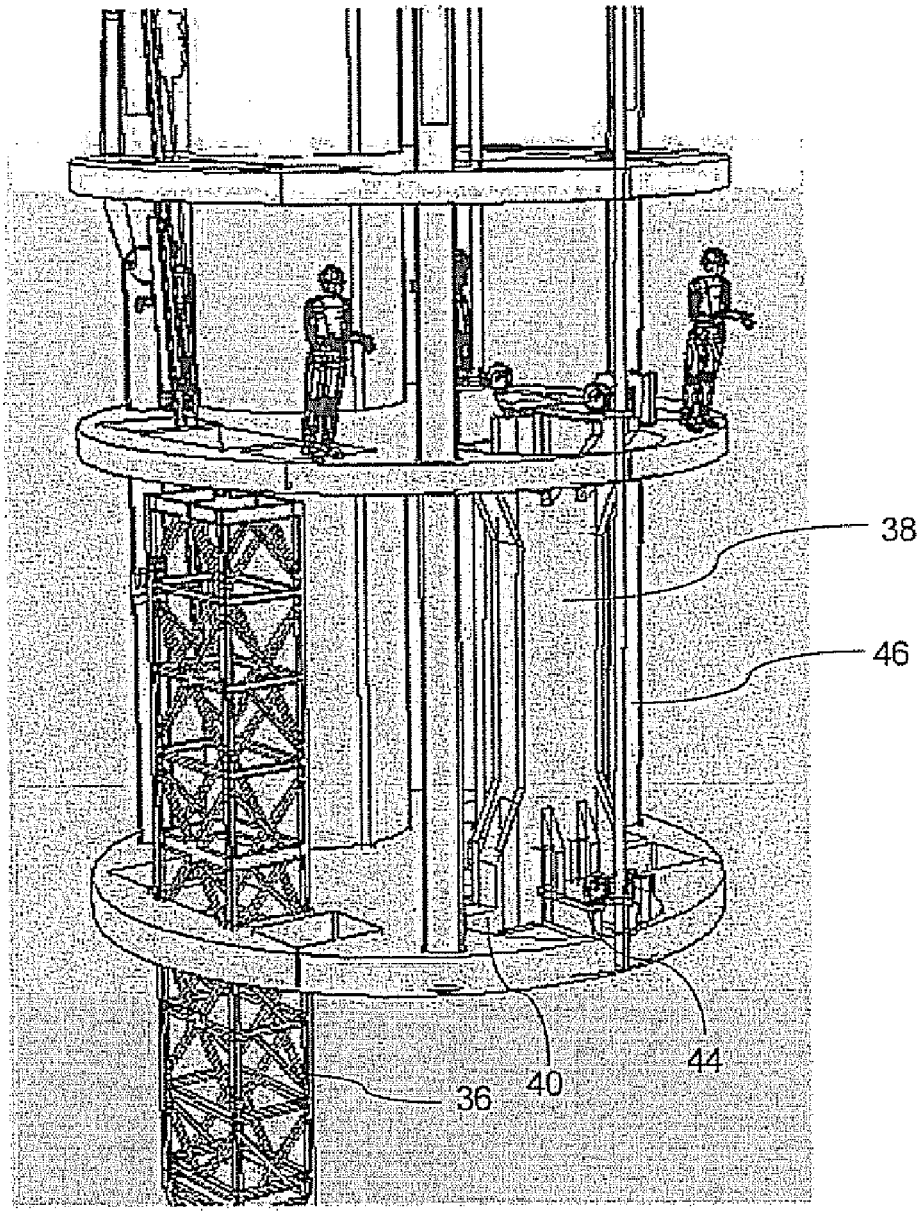
FIG. 7 is an exploded view of a chaired crosshead.
Figure 8:
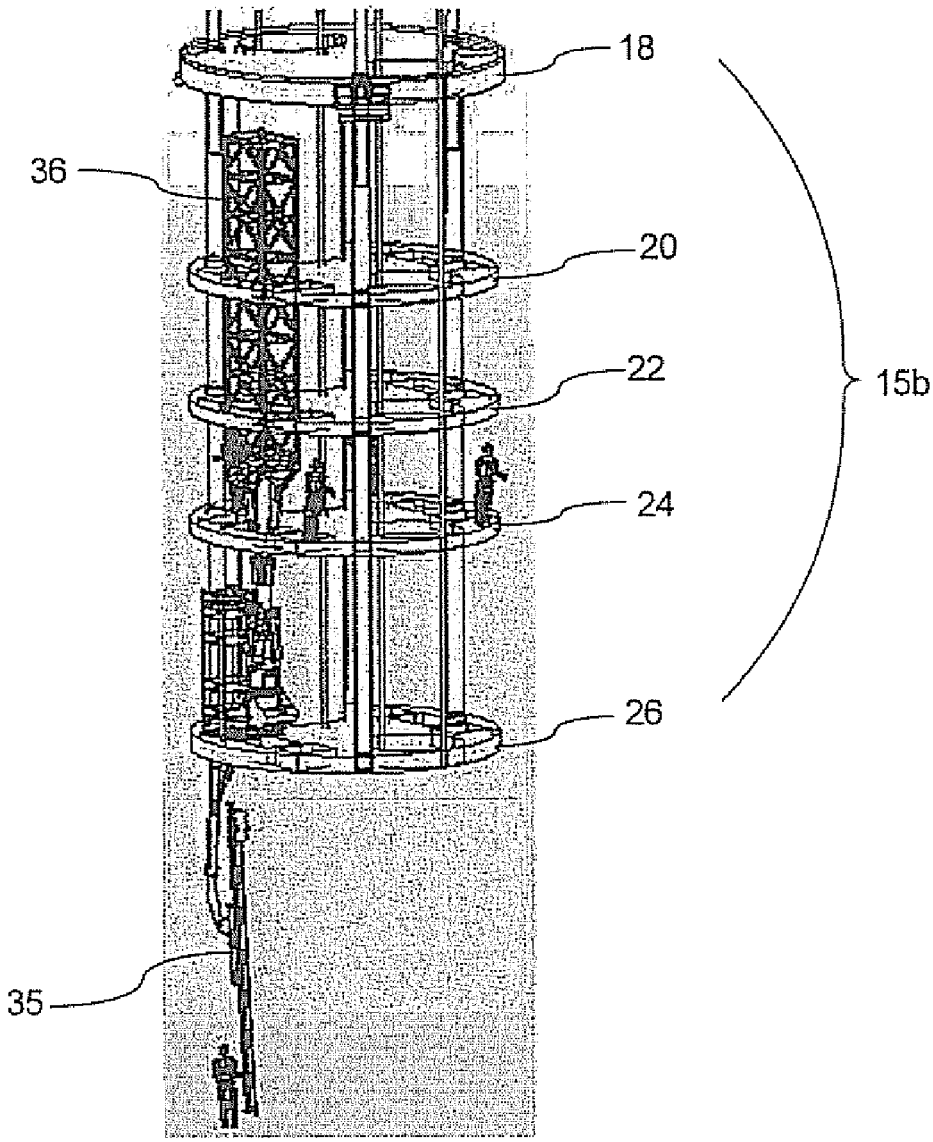
FIG. 8 is a view of the bottom section of the stage with a drill jumbo.
Figure 9:
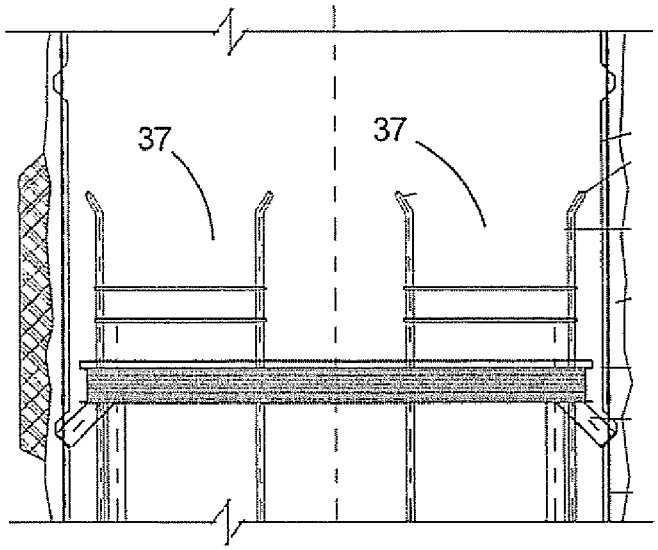
FIG. 9 is view of a chairing leg.
Figure 10:
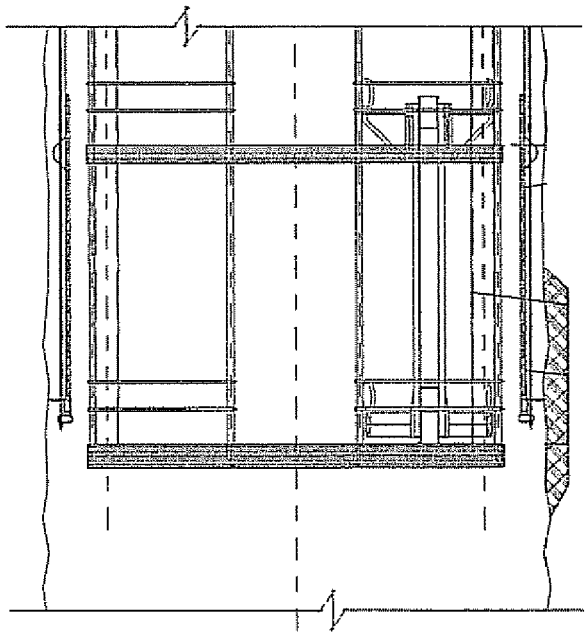
FIG. 10 is a view of a bucket well.

As maybe seen in FIGS. 4*c*, 7 and 10, the stage 15 is configured to accommodate a variety of excavation equipment. The decks 16-26 are configured to allow the equipment to pass through the stage 15 as required and each deck may be configured to support a particular piece of equipment or function. Accordingly, each of the decks has a pair of bucket wells 37 that permit movement of buckets through the stage 15. As shown, this includes bucket crossheads 38 for providing guide means for forcing a bucket 32 carrying shaft materials along a predetermined and predicted path up and down the shaft 12. The crossheads 38 include permanent guide shoes 40 adjacent to permanent guides 42. The permanent guides 42 are typically constructed of wood or structural steel shapes such as hollow structural sections, and fastened to a structural steel backer 43. Substantially perpendicular to the permanent guides shoes 40 are temporary guide roller shoes 44 which engage temporary guides 46. The crossheads 38 can thus be transferred between the permanent guides 42 and the temporary guides 46. Advantageously, by using the temporary guides 46, the crossheads 38 can descend through the stage 15 at increased speeds, such as 360 feet per minute, rather than the creep speed of 120 feet per minute, until the crossheads 38 are finally chaired at a bottom deck 26.

The temporary guides 46 are constructed from threaded heavy wall tubing that are anchored on the deck 16 and hang freely down and inside the bucket wells 45 of the main stage 15. The temporary guides 46 are threaded through sleeves in the well 45 at the bottom deck 26. When the stage 15 is raised the temporary guides 46 extend into the blast damage zone. However, the temporary guides 46 are positioned above the concrete forms to substantially diminish chances of damage by fly rock. Advantageously, if a temporary guide 46 is damaged during blasting another tube can easily be threaded in its place.

As stated above, the process of sinking shafts involves the step of drilling holes for placement of explosive charges. For this step, the drill jumbos 35 are lowered to drill into the bottom of the shaft 12 by making a cut comprising a hole or group of holes drilled in the centre of the shaft excavation which serve to weaken the formation. The charges are then placed in the cut such that the outside circumference of the shaft 12 implodes rather than explodes and thus he cut prevents expansion of the shaft diameter beyond a predetermined diameter. Genially, the number, pattern and size of these holes is determine by qualified personnel based on a plurality of factors, such as composition of the rock depth, shaft diameter, and so forth.

Figure 11:
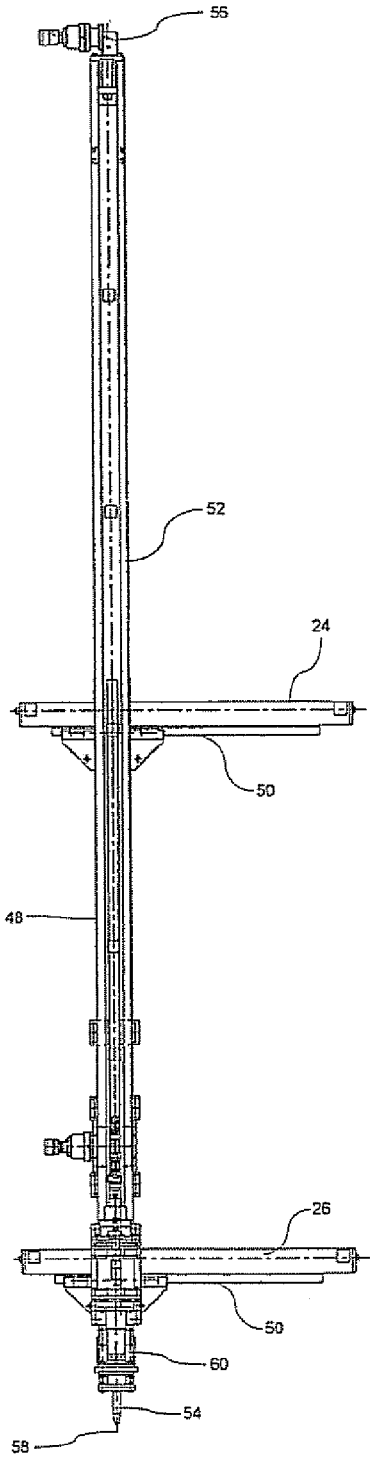
FIG. 11 is a side elevation view of a cut-boom.

Looking at FIG. 11, the drilling jumbo 35 includes a cut-boom drill 48 having mounting beams 50 affixed to the lower stage 15*b*, on the underside centre line of the two lower decks 24, 26. A feed rail assembly 52 moves firm side to side hydraulically on a slide arrangements affixed to the beams 50 and feed rail 52. The cut boom drill 48 can be removed between a positron with the lower stage 15*b* to another position beyond the deck 26 via the feed rail assembly. Thus, the feed rail 52 moves up and down on a slide arrangement using a roller chain, sprockets and a hydraulic motor 56. The feed rail 52 is stroked down until a stinger 54 contacts the shaft face securely. A drill bit 58 and length of rod 60 is threaded into the drive output and the "cut" is drilled off.

To facilitate removal of blast rock, a pair of mucking machines 36 are located on the lower stage 15*b*. The mucking machine 36 is slidably supported on the top deck 18 and can be lowered beyond the end of the bottom deck stage for loading spoil.

Figures 12A, 12B:
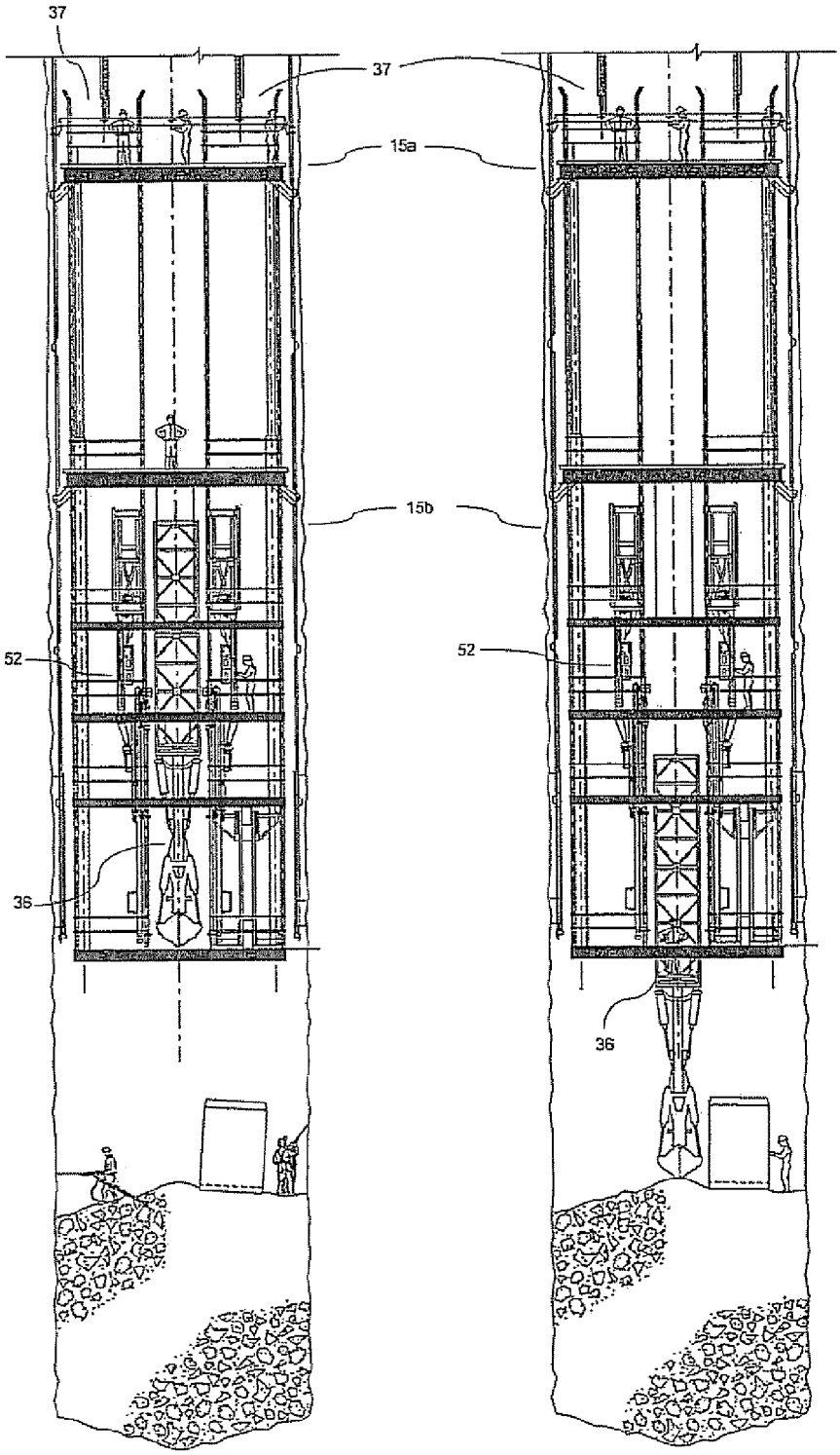
FIG. 12*a* is a view of the apparatus in operation.
FIG. 12*b* is another view of the apparatus in operation.
Figure 12C:
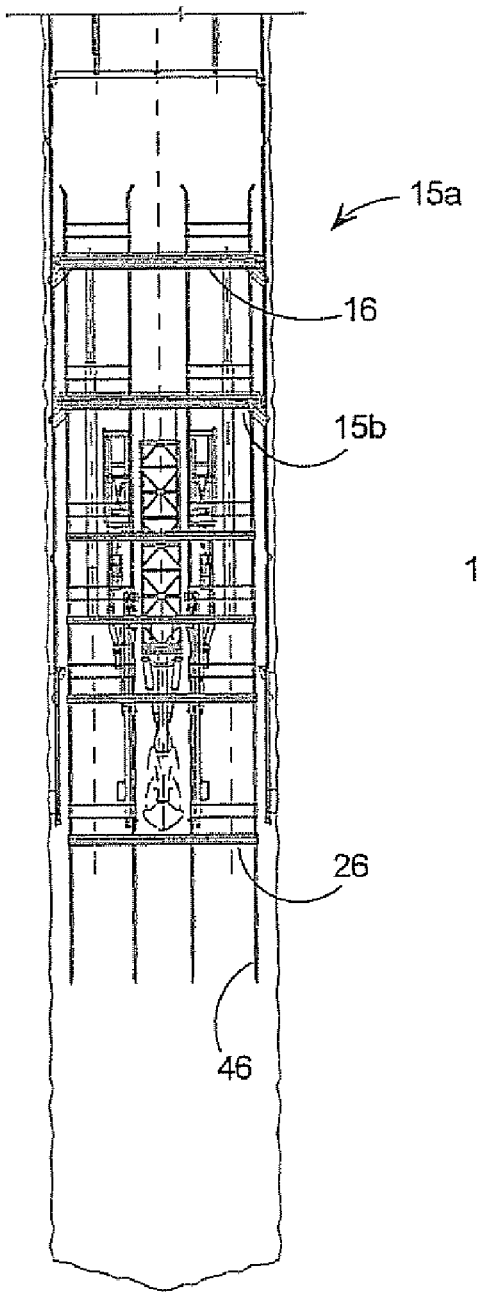
FIG. 12*c* is another view of the apparatus in operation.

The operation of the earth boring apparatus 10 will now be described by looking at FIGS. 6 to 15. In FIG. 12*a* the equipping deck 16 and the lower stage 15*b* are both chaired at a maximum extension of the cylinders 34, with the bottom deck 26 positioned at a sufficient distance from the bottom of the shaft 12 to allow personnel to work, drill and lay charges. FIG. 12*b* shows the mucking machine 36 lowered to transfer the muck from the bottom of the shaft 12 into the bucket 32 which can then be removed through the stage 15 and along the shaft, With the spoil removed, the upper portion 15*a* and equipping deck 16 is lowered (FIG. 12*c*) by retracing the legs 100 of upper deck 16. The cylinders are lowered to advance the deck 16 towards the chaired top deck

18. The equipping deck 16 comes to rest and is anchored at a predetermined distance from the top deck 18 while the lower stage 15*b* is chaired. In this position, it will be noted that the temporary guides 46 project below the bottom deck 26.

Figure 12D:
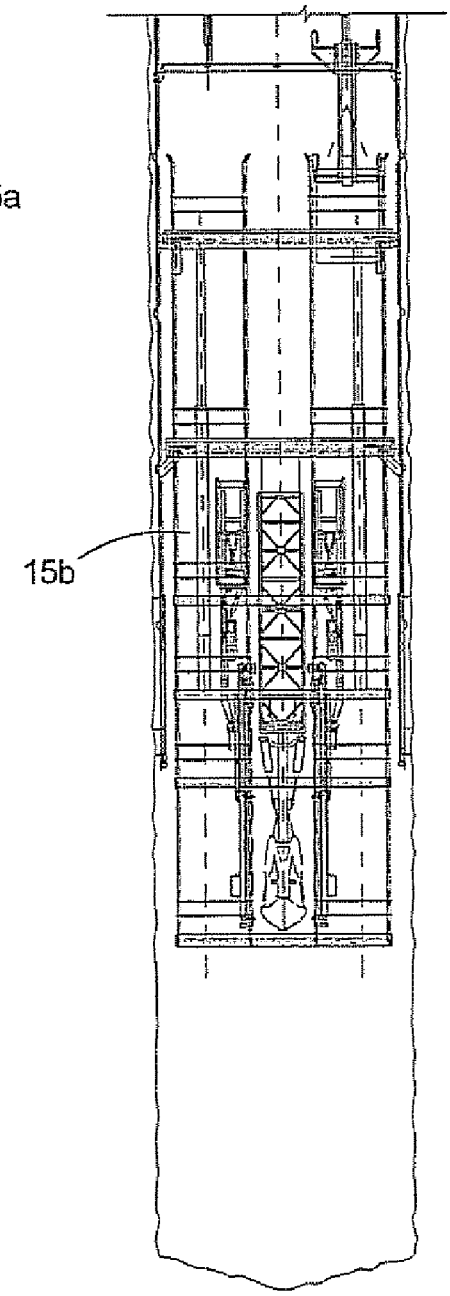
FIG. 12*d* is another view of the apparatus in operation.
Figures 13A, 13B:
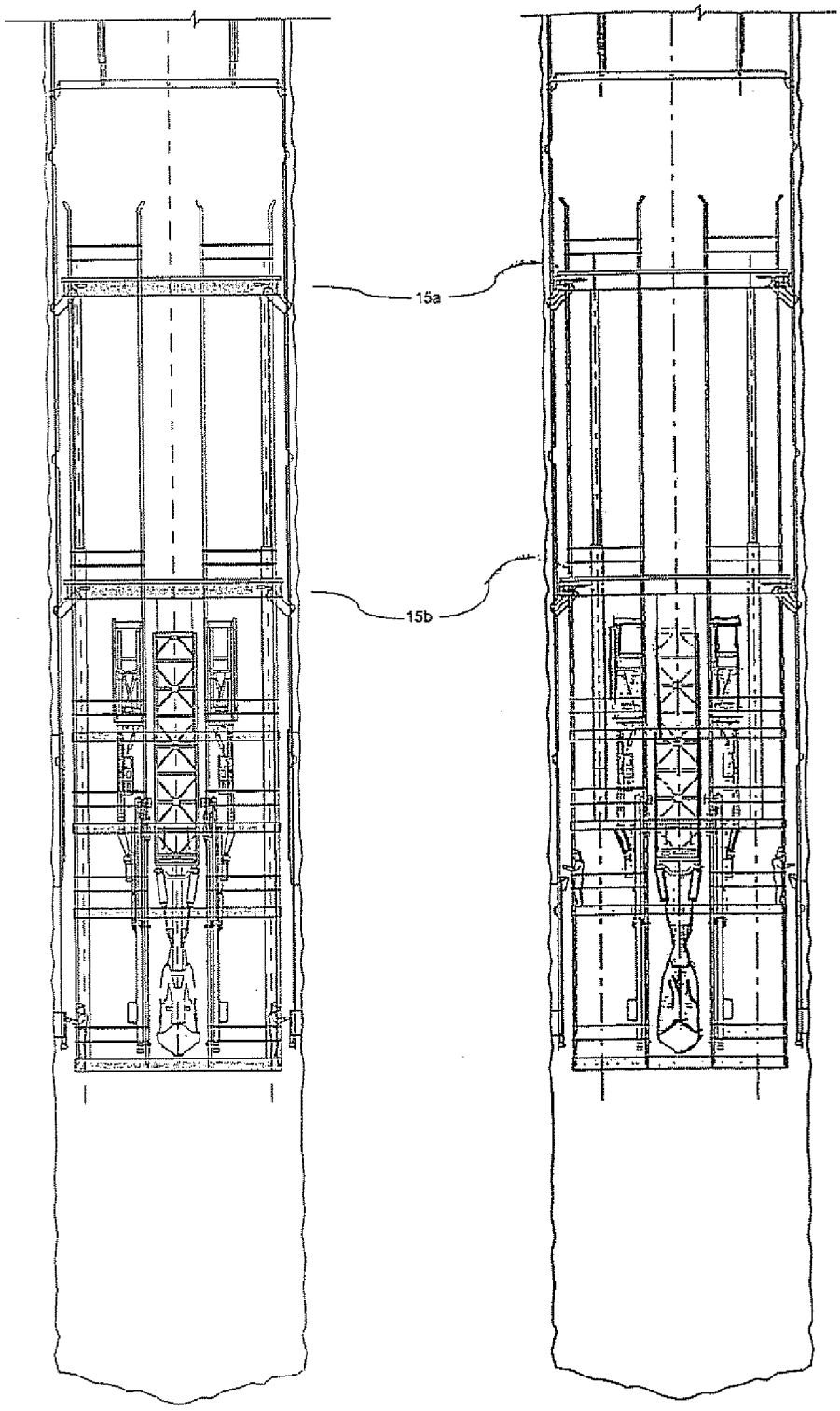
FIG. 13*a* is another view of the apparatus in operation.
FIG. 13*b* is another view of the apparatus in operation.

In FIG. 12*d*, the top deck chairing legs 100 are removed from the chairing pockets 30 and the lower stage 15*b* is lowered while the equipping deck 16 is chaired. After final positioning, the top deck 18 is chaired so that the bottom stage 15*b* is secured in the shaft in a configuration similar to FIG. 12*a* but lower. With the stage lowered, the wall 14 may be worked upon from the bottom deck 26. In FIG. 13*a* the equipping deck 16 and the lower stage 15*b* are both chaired while the curb forms are lowered including the A/ring and main forms, concrete, steel and other supplies. In this position the personnel can pour concrete or spray concrete onto the shaft walls 14 in order to reinforce the shaft walls 14 and define the chair pockets.

Figure 14A:
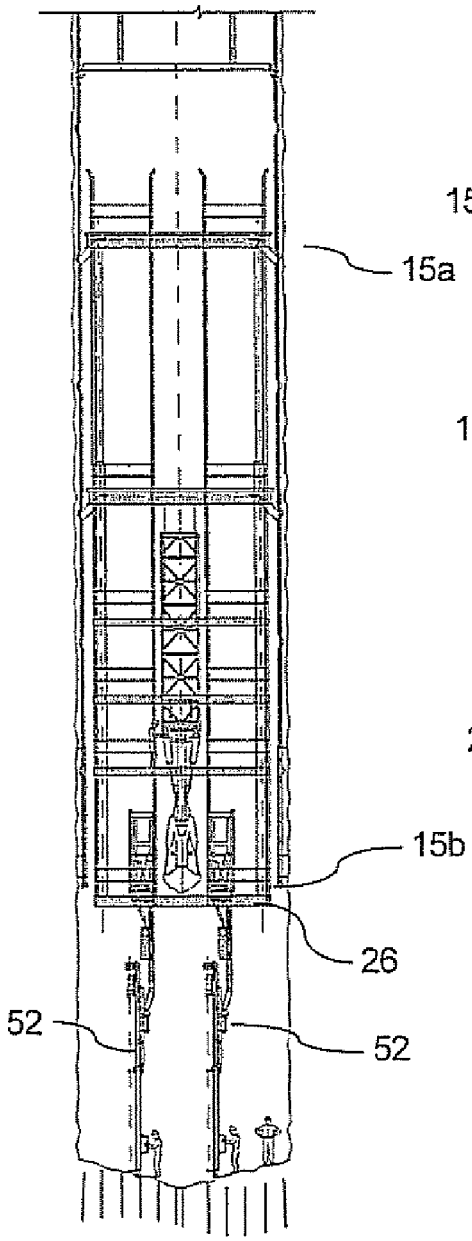
FIG. 14*a* is another view of the apparatus in operation.
Figure 14B:
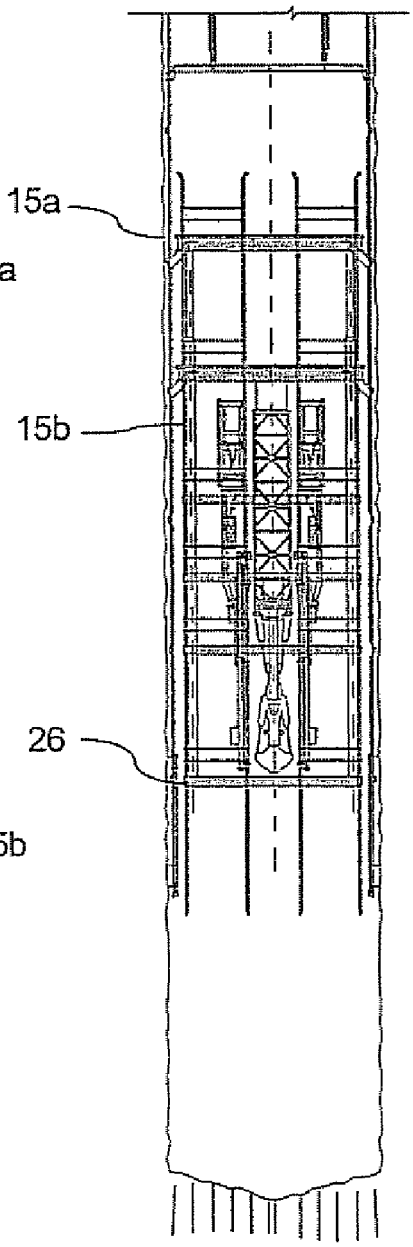
FIG. 14*b* is another view of the apparatus in operation.
Figure 15:
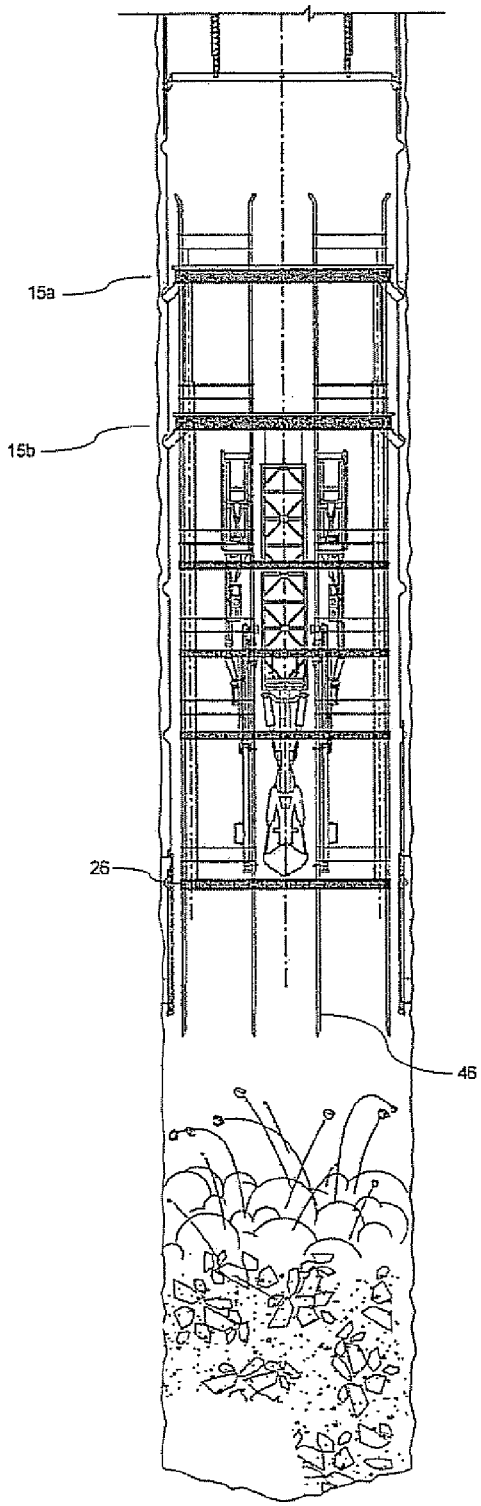
FIG. 15 is another view of the apparatus in operation.
Figure 16:
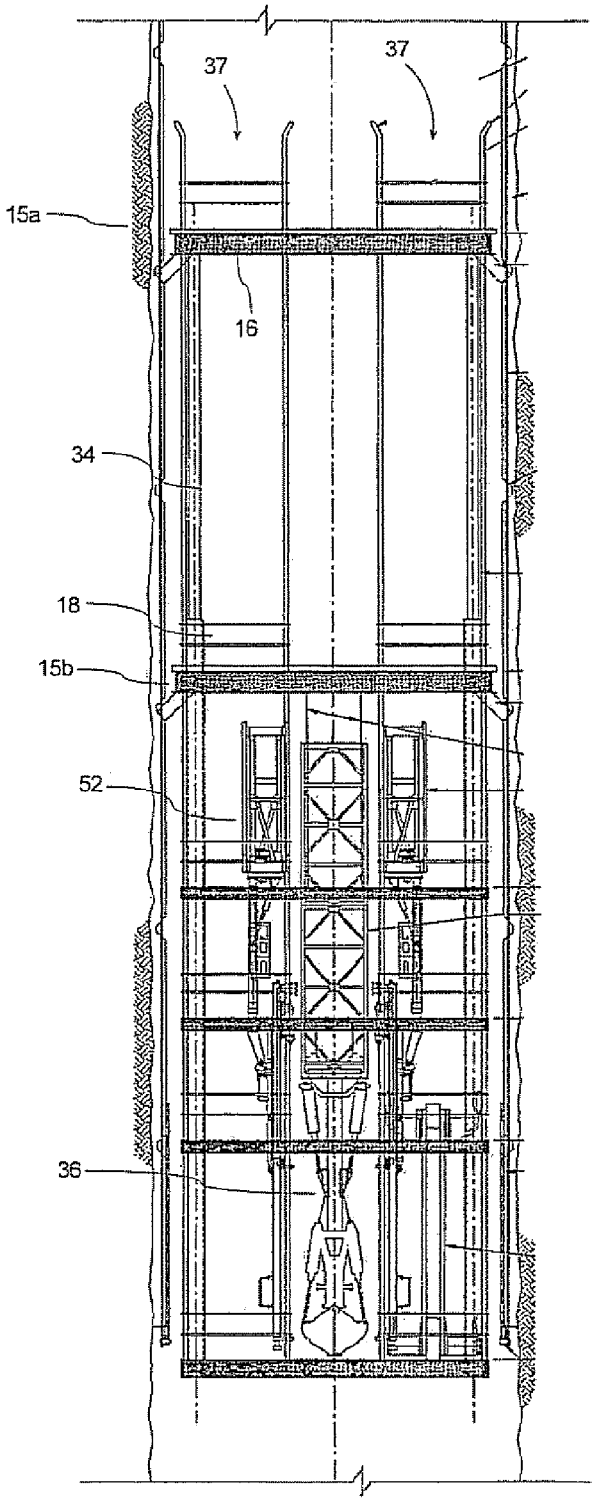
FIG. 16 is a section of the earth boring apparatus shown in FIG. 1.
Figure 17:
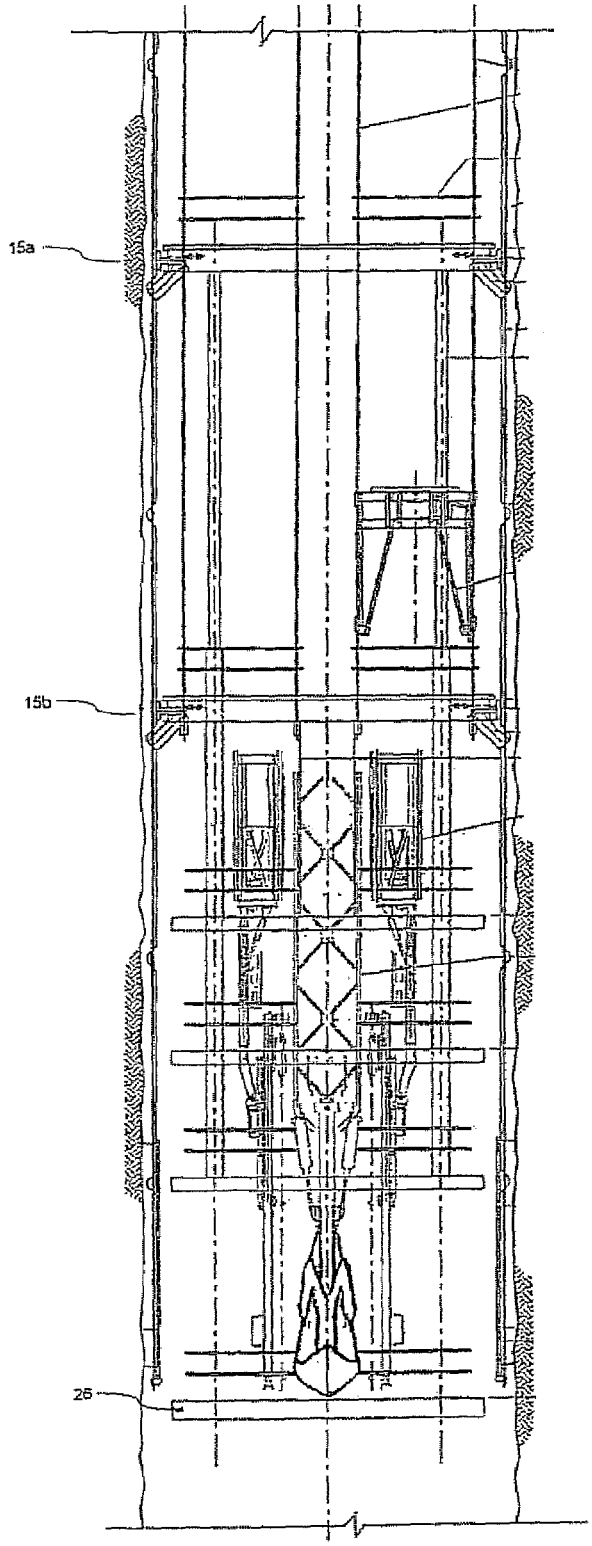
FIG. 17 is a view similar to FIG. 16 in an alternative configuration.

As shown in FIG. 14*a*, the drill jumbos 35 are lowered to drill into the bottom of the shaft 12 and lay charges in the drilled holes. With the equipping deck 16 chaired, the lower stage 15*b* is subsequently raised and chaired at a clearance distance from the blast area, in FIG. 14*b*, to allow for blasting by ignition to explode and loosen the rock material in FIG. 15. Once again the lower stage 15*b* is lowered and mucking and removal of muck begins, as described above. This process may be repeated several times depending on the desired results of the shaft mining or productivity requirements.

Although the invention has been described with reference to certain specific embodiments, various modifications thereof will be apparent to those skilled in the art without departing from the spirit and scope of the invention as outlined in the claims appended hereto.

The embodiments of the invention in which an exclusive property or privilege is claimed are defined as follows:

1. An earth boring apparatus for sinking shafts and removing shaft material from said shaft, said apparatus having;

at least two decks, one of said decks being associated with an upper stage portion and the other of said decks being associated with a lower stage portion;

extensible drive members acting between said decks for allowing movement of one of the decks relative to the other;

releasable anchors associated with respective ones of the decks for engaging walls of the shaft to secure the apparatus in a stationary position; and excavating equipment carried by said lower stage portion, said lower stage portion being adapted to permit deployment of said excavating equipment beyond said lower stage portion and to permit all of said equipment to be completely retracted therethrough such tat the underside of said lower stage portion is devoid of any of said excavating equipment thereby enabling said lower stage portion and said excavating eguipment to be moved away from the bottom of said shaft to permit blasting without moving said upper deck;

whereby the releasable anchors of one of the decks engages the wall while the releasable anchors of the other of the decks is released from the wall to allow motion of the other deck along the shaft, under control of said drive members.

2. The apparatus according to claim 1 wherein said releasable anchors include radially extending legs secured to respective ones of said decks.

3. The apparatus according to claim 2 wherein said legs are pivotally secured to respective ones of said decks.

4. The apparatus according to claim 1 wherein said extensible drive members include a hydraulic actuator.

5. The apparatus according to claim 1 wherein said lower stage portion has a plurality of decks arranged in axially spaced relationship.

6. The apparatus according to claim 1 wherein said equipment includes a drill.

7. The apparatus according to claim 1 wherein said equipment includes a mucking head.

8. The apparatus according to claim 7 wherein said mucking head is moveable axially relative to said lower stage portion.

9. The apparatus according to claim 1 wherein said equipment includes a bucket and crosshead.

10. A method of excavating a shaft comprising the steps of:

securing to a wall of a shaft, a stage having an upper stage portion and a lower stage portion wherein said lower stage portion carries excavating equipment and being adapted to permit deployment of said equipment beyond said lower stage portion and to permit said equipment to be retracted therethrough;

deploying said excavating equipment through said lower stage portion;

excavating said shaft beneath said lower stage portion;

retracting all of said excavating equipment through said lower stage portion such that the underside thereof is devoid of any said excavating eguipment thereby enabling said lower stage portion and said excavating equipment to be moved away from the bottom of said shaft to permit blasting without moving said upper deck;

lowering said lower stage portion;

securing said lower stage portion to a wall of said shaft;

releasing said upper stage portion from said wall; and lowering said upper stage portion toward said lower stage portion.

* * * * *